United States Patent [19]

Blanchette

[11] Patent Number: 4,930,656

[45] Date of Patent: Jun. 5, 1990

[54] CONTAINER LID WITH A TEAR SKIRT

[75] Inventor: Henry J. Blanchette, Leominster, Mass.

[73] Assignee: Plastican, Inc., Leominister, Mass.

[21] Appl. No.: 311,116

[22] Filed: Feb. 15, 1989

[51] Int. Cl.[5] ..... B65D 17/40

[52] U.S. Cl. ..... 220/276; 220/256; 220/269; 220/270

[58] Field of Search ..... 220/276, 265, 268, 269, 220/270, 355

[56] References Cited

U.S. PATENT DOCUMENTS

| | | | |
|---|---|---|---|
| 4,037,748 | 7/1977 | Stubbs, Jr. | 220/270 X |
| 4,625,876 | 12/1986 | Bullock, III | 215/256 |
| 4,718,571 | 1/1988 | Bordner | 220/276 X |
| 4,735,337 | 4/1988 | Von Holdt | 220/276 |
| 4,798,301 | 1/1989 | Bullock et al. | 215/256 |
| 4,819,825 | 4/1989 | Landis | 220/276 |

FOREIGN PATENT DOCUMENTS

| | | | |
|---|---|---|---|
| 204942 | 1/1959 | Fed. Rep. of Germany | 220/270 |
| 2336582 | 1/1974 | Fed. Rep. of Germany | 220/276 |
| 3233805 | 3/1984 | Fed. Rep. of Germany | 215/256 |
| 92382 | 9/1968 | France | 215/256 |
| 290066 | 11/1931 | Italy | 220/270 |
| 177835 | 10/1957 | Sweden | 220/270 |
| 1136030 | 12/1968 | United Kingdom | 215/254 |
| 1335722 | 10/1973 | United Kingdom | 220/270 |
| 2134499 | 8/1984 | United Kingdom | 220/269 |

*Primary Examiner*—Stephen P. Garbe
*Assistant Examiner*—Christine A. Peterson
*Attorney, Agent, or Firm*—Schiller, Pandiscio & Kusmer

[57] ABSTRACT

A lid for sealing a container has a removable tear skirt. The lid includes a cap portion with a circular crown and depending sidewall. An undulating annular groove which defines a frangible thin walled strip divides the sidewall into an upper section and a lower tear skirt. The cap portion has a reinforced inner wall assembly that is spaced apart from an outer depending wall, the tear skirt being attached to a lower portion of the outer wall. A weakened area adjacent to and intersecting a small lateral slot formed in the undulating groove facilitates breaking of the tear skirt. When the tear skirt is removed, a plurality of bendable flaps are formed at the lower portion of the outer wall. A fastening rib formed on an inner surface of the outer wall is configured to lockingly engage a locking flange on the container for securing the lid to the container. Opening slots provided in the flaps are configured to receive a tool for disengaging the fastening ribs and the locking flange.

17 Claims, 4 Drawing Sheets

CONTAINER LID WITH A TEAR SKIRT

BACKGROUND OF THE INVENTION

1. Field of the Invention

The present invention relates to lids for containers and, more particularly, is directed to a lid container with a tear skirt.

2. Description of the Prior Art

Lids that make a seal with the top of a container so as to result in a capped container are well known. Sealed containers of this type are used for paint, asphalt, joint compound and the like. In recent years, such containers have been made of plastic, rather than metal.

Plastic containers with mating lids are exemplified in U.S. Pat. No. 4,210,258 and United Kingdom Patent No. 1,582,416. Plastic container lids with removable tear strips are shown in U.S. Pat. Nos. 4,362,252; 4,397,404; 4,417,666; 4,484,687; 4,538,740; 4,561,553; and 4,676,389 and the references cited therein.

One type of lid for a plastic container has a depending wall with an annular straight groove on the inner side of the wall adjacent a bottom edge thereof. The portion of the wall below the groove defines a removable tear skirt. At least one hole is provided in the depending wall at the site of the groove in order to facilitate removal of the skirt. The hole permits a person to break away the lower part of the wall so that it can be torn off along the annular groove. Tearing away the bottom portion of the wall makes it easier to flex the sidewall so as to remove the lid from the container. However, this type lid has been met with varying degrees of success because of the difficulty in manufacturing such a lid. In particular, it is difficult to precisely control the wall thickness of the straight groove which determines the effort required to remove the bottom portion of the sidewall. The wall thickness of the groove must be sufficiently thin to permit easy removal of the tear skirt and sufficiently thick to prevent unwanted premature tearing of the tear skirt.

In addition to the foregoing disadvantages, due to the straight sidewall edge that remains after removal of the tear skirt, the sidewall is still relatively inflexible so that a considerable flexing force must be applied to pry the lid of the container.

SUMMARY OF THE INVENTION

It is an object of the present invention to provide a container lid that is free of or substantially avoids or reduces the heretofore mentioned disadvantages and limitations.

Another object of the present invention is to provide a container lid with a sidewall having a tear skirt that is easily broken away from the rest of the sidewall.

A further object of the present invention is to provide a container lid with a sidewall having a tear-skirt at a lower margin thereof. The lid is configured to lockingly engage and seal the container, with the lid being difficult to remove from the container until the tear skirt has been torn away in full or in part.

Yet another object of the present invention is to provide a container lid that is adapted to be securely locked to a container by a pressure fit, but which has an easily removable tear skirt, so that the lid can be detached from the container using conventional methods once the tear skirt has been removed.

A container lid embodying the present invention is characterized by an upper cap portion having a sidewall and a lower tear skirt that forms part of the sidewall. An undulating groove in the sidewall forms a frangible thin wall section between the upper cap portion and the lower tear skirt and a plurality of spaced vertical reinforcing ribs span the undulating groove. The cap portion is a multiple wall structure having a reinforced inner wall assembly that is spaced apart from the outer depending sidewall. A fastening rib formed on an inner surface of the sidewall above the tear skirt is configured to lockingly engage the lid of a container. A weakened area adjacent a small lateral slot formed in the undulating groove facilitates initially breaking of the tear skirt, the initial torn portion of the tear skirt adjacent the slot forming a tab for tearing the tear skirt away from the cap portion. When the tear skirt is removed, a plurality of bendable flaps are formed at the lower portion of the sidewall. Slots formed in the flaps below the fastening ribs are configured to receive a tool for bending the flaps until the fastening rib of that flap is disengaged from a locking flange on the container. Other features and advantages of the invention are exemplified in the following disclosure, the scope of which will be indicated in the appended claims.

A fuller understanding of the nature and objects of the present invention will become apparent upon consideration of the following detailed description taken in connection with the accompanying drawings.

DETAILED DESCRIPTION OF THE PREFERRED EMBODIMENTS

Figure 1:
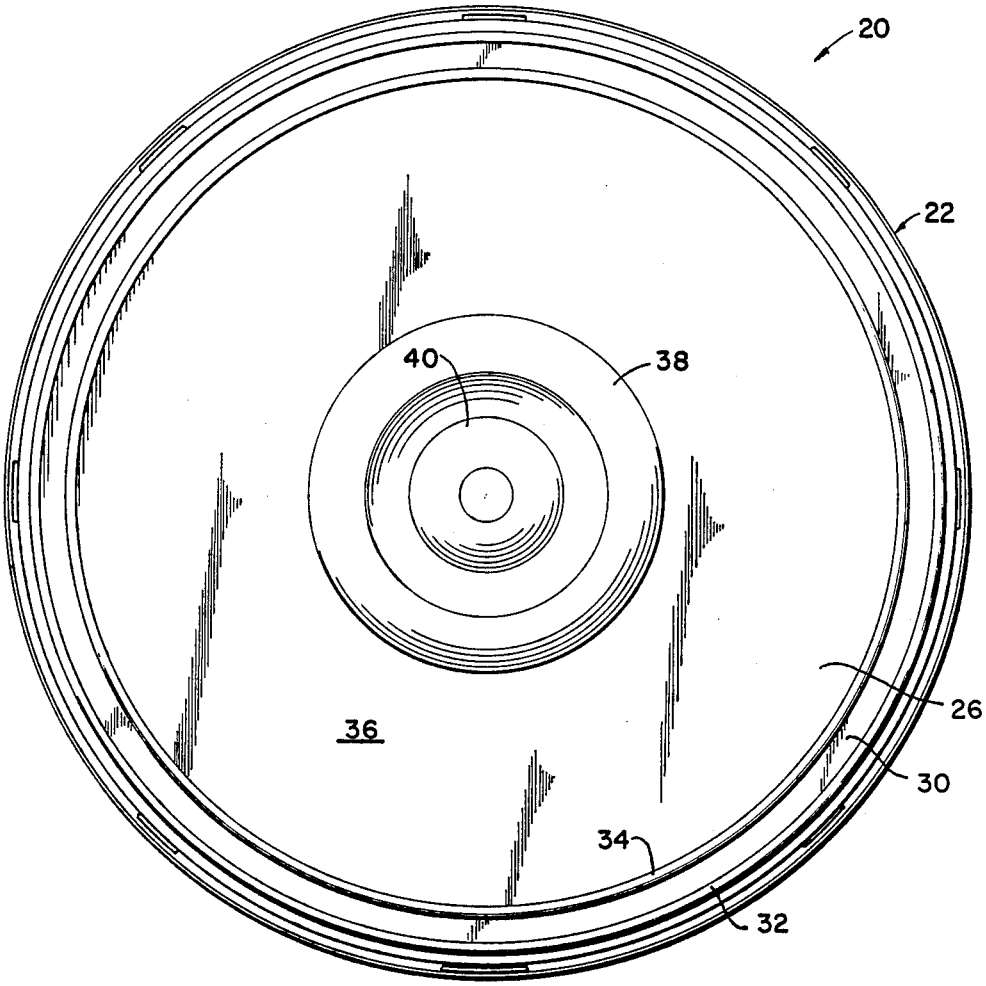
FIG. 1 is a top view of a container lid with a tear skirt embodying the present invention.

Referring now to the drawings, particularly FIGS. 1–4, there is shown a container lid 20 embodying the present invention. Lid 20 comprises a cap 22 which includes a circular crown or top wall 26 and a cylindrical sidewall 28 that depends from the top wall. Sidewall 28 is formed with a uniformly undulating annular groove 29 that divides the sidewall into an upper section 31 and a lower section or tear skirt 24.

Top wall 26 has an outer annular flange 30 with a pair of raised concentric annular ribs 32, 34. Flange 30 bounds an inner depressed section 36 that has a cylindrical sidewall 46 and a pair of raised concentric rings 38 and 40 that provide stiffness to top wall 26.

Figure 3:
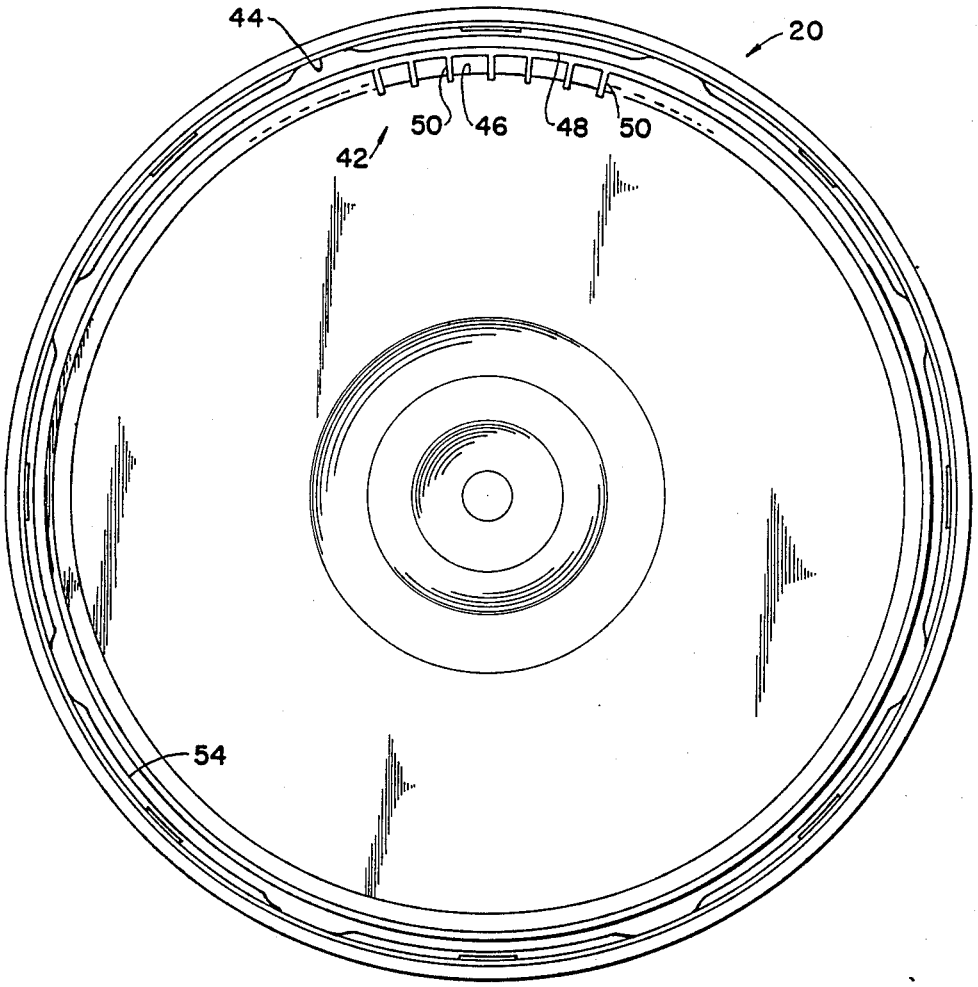
FIG. 3 is a bottom view of the lid of FIG. 1.
Figure 4:
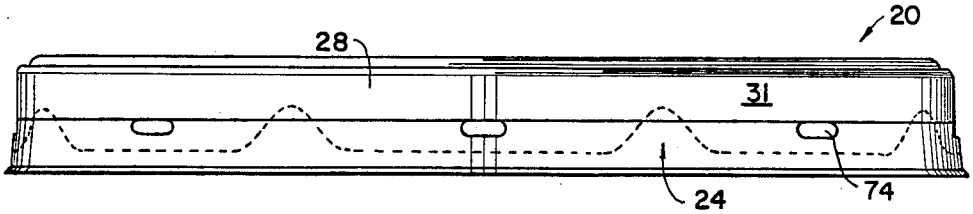
FIG. 4 is a side view of the back side of the lid (i.e., 180 degrees removed from the view of FIG. 2)
Figure 6:
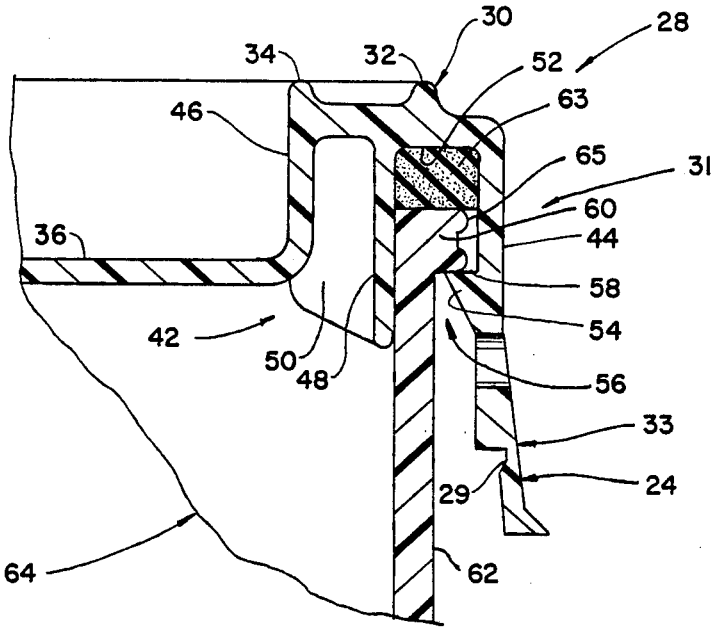
FIG. 6 is an enlarged fragmentary sectional view showing the lid sealed on a container.

As best shown in FIGS. 3 and 6, sidewall 28 is a multiple wall structure 42 having and an outer wall 44 and an inner wall 48. A plurality of circumferentially spaced, radially extending, reinforcing ribs 50 connect to and extend between inner wall 48 and sidewall 46 so as to make inner wall 48 a substantially rigid structure that is spaced apart from outer wall 44. A channel 52 is formed between inner wall 48 and outer wall 44.

A plurality of circumferentially spaced fastening ribs 54 are formed on an interior surface of outer wall 44, the fastening ribs extending into channel 52. Each fastening rib 54 is tapered inwardly toward inner wall 48 from an entrance way 56 that is formed between outer wall 44 and the inner wall. Each fastening rib 54 forms a step 58 that is configured to make a snap lock connection with a mating locking flange 60 on a sidewall 62 of a container 64 (FIG. 6) when lid 20 is pressed onto the container.

Figure 5:
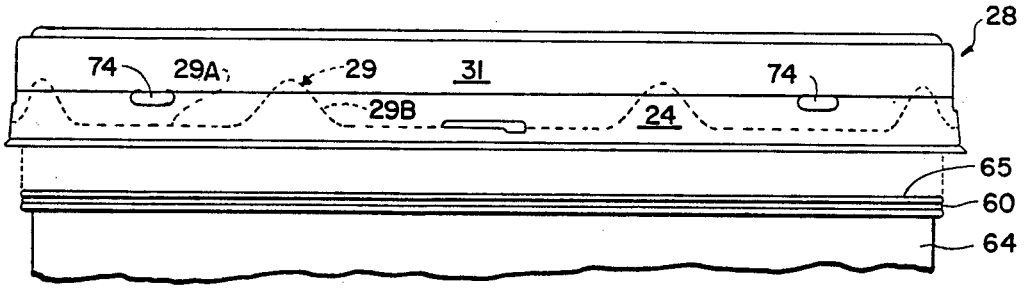
FIG. 5 is a side view showing the lid about to be placed on a container.
Figure 7:
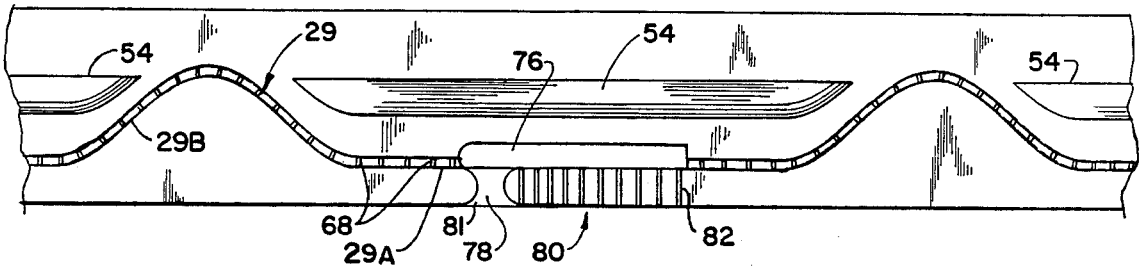
FIG. 7 is an enlarged fragmentary view in elevation showing the inner side tear skirt and a fastening rib.
Figure 8:
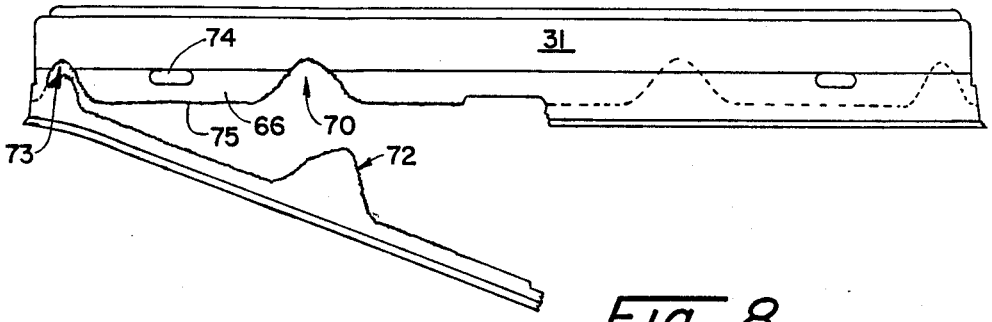
FIG. 8 is a side view of the front side of the lid showing initial separation of the tear skirt.

A resilient seal 63, for example an elastomeric O-ring, is captively positioned in channel 52 so as to make a tight seal with container 64. In an alternative embodiment, resilient seal 63 is a solid poured-in gasket. When lid 20 is pressed on container 64, the upper edge 65 of the container presses against seal 63. Lid 20 is captively held on container 62 by the mating engagement of fastening ribs 54 on the lid and locking flange 60 on the container. Outer wall 44 and attached tear skirt 24 form a somewhat inflexible structure that cannot be bent easily to disengage fastening ribs 54 from locking flange 60 as is required to remove lid 20 from container 62. However, as hereinafter described, when tear skirt 24 is separated from outer wall 44, the bottom edge of the outer wall is undulated and forms a plurality of flexible flaps 66 (FIG. 8). As best shown in FIGS. 5 and 7, undulating annular groove 29 includes a relatively long and straight portion 29A that is disposed below each fastening rib 54 along the lower edge of each flexible flap 66, and a relatively short and curved section 29B that is disposed between adjacent ones of the fastening ribs 54.

As best shown in FIGS. 2, 4, 5 and 7, 8, the undulating annular groove 29 that is formed in outer wall 44 defines a frangible thin walled section or tear line 37 that divides the outer wall into upper section 31 and lower tear strip 24. The inner side of thin wall section 29 is formed with a series of circumferentially spaced depressions, so as to provide a series of spaced longitudinally extending ribs 68 (FIG. 7). The thickness of ribs 68 is set as to provide strip 33 with sufficient strength so as to prevent accidental tearing of the frangible tear line 37, and yet they are sufficiently thin to permit the frangible wall section 33 to be torn easily when it is desired to unseal lid 20.

As best shown in FIG. 8, when tear skirt 24 is separated from upper section 31, a scalloped or undulating bottom edge 70 is formed or remains on outer wall 44 and the upper edge 72 of tear skirt 24 is similarly shaped. Flexible flaps 66 are formed by undulating edge 70, with a valley 73 being formed between adjacent flaps. By way of example, in a preferred embodiment, the height of valley 73 between adjacent flaps 66 is approximately 0.75 inches and the distance between adjacent flaps at a bottom edge 75 of the upper section 31 is approximately 1.5 inches. Also by way of example, in the illustrated embodiment, each flexible flap 66 carries one fastening rib 54. In an alternate embodiment, a fastening rib 54 is on selected ones of the flexible flaps 66. A laterally extending slotted opening 74 is formed in each flexible flap 66 below fastening rib 54. Each slotted opening is 74 is configured to receive a flat tool (not shown), for example, a slotted screwdriver blade for use in bending flexible flaps 66 so as to disengage fastening ribs 54 and locking flange 60 to remove lid 20.

Figure 2:
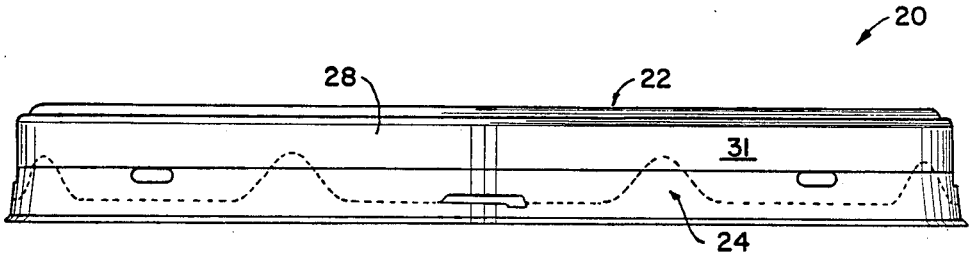
FIG. 2 is a side view of the front side of the lid of FIG. 1 showing the break away tab.

As best shown in FIGS. 2, 5 and 7, a laterally elongated slot 76 is formed in a portion of outer wall 44 and undulating groove 29. A longitudinal depression or groove 78 which is formed in the inner surface of tear skirt 24 below undulating groove 29, intersects lateral slot 76 and defines a thin walled frangible area 81 which is easily ruptured to facilitate breaking of the tear skirt. When area 81 is ruptured, a tab 80 is formed, the tab 80 having a series of spaced ribs 82. Tab 80 defines a purchase for tearing wall 44 along undulated groove 29 and thereby separating tear skirt 24 from outer wall 44.

Either a pair of pliers (not shown) or a flat tool (not shown), for example a slotted screwdriver, can be used for breaking tear skirt 24 and for removing lid 20. If a pair of pliers is used, tab 80 is grabbed and twisted until tear skirt 24 breaks at frangible area 81. If a screwdriver is used, the blade of the screwdriver is inserted into elongated slot 76 and the handle of the screwdriver is pushed toward the center of lid 24 until tear skirt 24 breaks at frangible area 81. Then, tab 80 is pulled, tearing outer wall 28 along undulating groove 29 and separating tear skirt 24 from upper section 31. Next the screwdriver blade is inserted into one of the openings 74 and the associated flexible flap 66 is bent upwardly and outwardly until fastening rib 54 and locking flange 60 are separated from one another. Then, lid 20 is lifted upwardly, so that the side of the disengaged fastening rib 54 is pressed against the side of locking flange 60. The screwdriver blade is then placed in an adjacent opening 74, the associated flap 66 is bent outwardly and the fastening rib 54 is pulled away from locking flange 60. The process continues until a sufficient number of fastening ribs 54 have disengaged the locking flange 60 to permit removal of lid 20. Container 64 can recapped by placing lid 20 onto the container and pressing downwardly on the lid or banging on the lid with a hammer (not shown) until all the fastening ribs 54 are in locked engagement with locking flange 60.

An advantage of this invention is that when tear skirt 24 is fully separated from lid 20, the lid has the appearance of metal lids that have been used for many years on metal containers for asphalt coatings. However, unlike those metal lids, the lid 20 of this invention is made of a resilient plastic such as polyethylene or polypropylene and hence can be reattached to the container 64 by virtue of its snap locking connection so as to hermetically seal the container.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A lid configured to be mounted on a container having a locking flange about an upper edge thereof, said lid comprising:

(a) an upper cap portion with a depending outer outer sidewall;

(b) a lower portion of said sidewall defining a tear skirt;

(c) an undulating annular groove in said sidewall forming a frangible thin wall section between said upper cap portion and said tear skirt, said undulating annular groove facilitating separation of said upper cap portion and said tear skirt;

(d) a plurality of spaced fastening means circumferentially disposed on an upper portion of said sidewall, said fastening means configured to be in locking engagement with the container locking flange for locking said lid on the container; and (e) a plurality of bendable flaps formed at a lower margin of said upper cap portion by said undulating annular groove when said tear skirt is separated from said upper cap portion, all of said fastening means being disposed on said upper cap portion that remains after separation of said tear skirt;

(f) said undulating annular groove having a relatively long and straight portion that is disposed in a path that passes below said fastening means along a lower edge of said flaps and a relatively short and curved section that is disposed in a path that passes between adjacent ones of said fastening means.

2. The lid as claimed in claim 1 wherein said cap portion is a multiple wall structure having a reinforced inner wall assembly and an outer wall, said inner wall assembly being spaced apart from said outer wall, a channel formed between said inner wall assembly and said outer wall, said channel configured to receive the upper edge of the container, said tear skirt being attached to a lower portion of said outer wall.

3. The lid as claimed in claim 2 wherein said fastening means includes a fastening rib formed on an interior wall of selected ones of said flaps within said channel, said fastening ribs configured to lockingly engage the locking flange on the container.

4. The lid as claimed in claim 1 including a series of spaced, longitudinally extending strengthening ribs formed in said undulating annular groove, said ribs extending between opposed edges of said undulating annular groove.

5. The lid as claimed in claim 1 including a lateral slot separating said upper cap portion and said tear skirt, a section of said tear skirt bounded by said lateral slot defining a purchase for facilitating tearing of said undulated undulating annular groove.

6. The lid as claimed in claim 5 including a weakened area formed in said tear skirt, said weakened area intersecting said lateral slot to facilitate breaking of said tear skirt.

7. A lid configured to be mounted on a container having a locking flange about an upper edge thereof, said lid comprising:

(a) an upper cap portion with a depending sidewall;

(b) a lower portion of said sidewall defining a tear skirt;

(c) an undulating annular groove forming a frangible thin wall section between said upper cap portion and said tear skirt, said undulating annular groove having a relatively long and straight portion and a relatively short and curved section, said undulating annular groove facilitating separation of said tear skirt from said upper cap portion;

(d) a plurality of bendable flaps formed at a lower margin of said upper cap portion by said undulating annular groove when said tear skirt is separated from said upper cap portion, each said flap having a relatively long and straight lower edge;

(e) a plurality of circumferentially disposed fastening ribs, at least one fastening rib formed on an interior wall of each one of said flaps, all of said fastening ribs being disposed on said upper cap portion that remains after separation of said tear skirt, said fastening ribs configured to be in locking engagement with the locking flange on the container; and (f) an opening formed in selected ones of said flaps, said openings configured to facilitate bending of said flaps for disengaging said fastening ribs and the locking flange;

(g) said relatively long and straight portion of said undulating annular groove forming said lower edge of each said flap, said relatively short and curved section of said undulating annular groove being disposed in a path that passes between adjacent ones of said fastening ribs.

8. The lid as claimed in claim 7 wherein said cap portion is a multiple wall structure having a reinforced inner wall assembly and an outer wall, said inner wall assembly being spaced apart from said outer wall, a channel formed between said inner wall assembly and said outer wall, said channel configured to receive the upper edge of the container, said fastening ribs formed in an interior surface of said outer wall within said channel, said tear skirt being connected to a lower portion of said outer wall.

9. The lid as claimed in claim 7 including a series of spaced, longitudinally extending strengthening ribs formed in said undulating annular groove, said ribs extending between opposed edges of said undulating annular groove.

10. The lid as claimed in claim 9 including a lateral slot formed in one of said upper cap portion and said tear skirt adjacent said undulating annular groove, a section of said tear skirt bounded by said lateral slot defining a purchase for facilitating tearing of said thin walled section.

11. The lid as claimed in claim 10 including a weakened area formed in said tear skirt adjacent to and intersecting said lateral slot to facilitate breaking of said tear skirt.

12. A lid configured to be mounted on a container having a locking flange about an upper edge thereof, said lid comprising:

(a) a cap having a crown, a sidewall and a multiple wall assembly depending from said crown, said multiple wall assembling including an inner wall and outer wall, a series of reinforcing ribs connected to adjacent opposed surfaces of said inner wall and said sidewall to form a substantially rigid structure, a channel formed between said inner wall and said outer wall, said channel configured to receive the locking flange of the container;

(b) an undulating annular groove formed in said outer wall between an upper edge and a lower edge thereof, said undulating annular groove having a series of relatively long and straight portions and a series of relatively short and curved sections, one of said short and curved sections positioned between adjacent ones of said relatively long and straight portions, and undulating annular groove forming a frangible thin walled strip in said outer wall, said thin walled strip dividing said outer wall into an upper section and a lower section, said lower section defining a tear skirt;

(c) a plurality of bendable flaps formed at a lower margin of said upper section by said undulating annular groove when said tear skirt is separated from said upper section, each said flap having a relatively long and straight lower edge that is formed by said relatively long and straight portion of said undulating annular groove when said tear skirt is separated from said upper section;

(d) a fastening rib formed on an interior surface of each one of said flaps, all of said fastening ribs being disposed on said upper section that remains after separation of said tear skirt, said fastening ribs configured to be in locking engagement with the locking flange on the container, said relatively short and curved section being disposed in a path that passes between adjacent ones of said fastening ribs, said relatively long and straight portion being disposed below each said fastening rib; and (e) an opening formed in selected ones of said flaps, said openings configured to facilitate bending of said flaps for disengaging said fastening ribs and the locking flange for removing said lid from the container.

13. The lid as claimed in claim 12 including a series of spaced longitudinally extending strengthening ribs that are formed in said undulating annular groove, said ribs extending between opposed edges of said undulating annular groove, said ribs being sufficiently thick to strengthen said frangible thin walled strip and prevent accidental tearing and sufficiently thin to permit said strip to be torn easily for separating said tear skirt from said outer wall.

14. The lid as claimed in claim 13 including an elongated lateral slot formed in a portion of said outer wall and said undulating annular groove, a tab formed in a section of said tear skirt bounded by said lateral slot, said tab defining a purchase for facilitating separation of said tear skirt from said upper section.

15. The lid as claimed in claim 14 including a weakened area formed in said tear skirt, said weakened area adjacent to and intersecting said lateral slot to facilitate breaking of said tear skirt.

16. A lid configured to be mounted on a container having a locking flange about an upper edge thereof, said lid comprising:

(a) a cap having a crown, a sidewall and a multiple wall assembly depending from said crown, said multiple wall assembly including an inner wall and outer wall, a series of reinforcing ribs connected to adjacent opposed surfaces of said inner wall and said sidewall to form a substantially rigid structure, a channel formed between said inner wall and said outer wall, said channel configured to receive the locking flange of the container;

(b) an undulating annular groove formed in said outer wall between an upper edge and a lower edge thereof, said undulating annular groove having a series of relatively long and straight portions and a series of relatively short and curved sections, one of said short and curved sections positioned between adjacent ones of said relatively long and straight portions, said undulating annular groove forming a frangible thin walled strip in said outer wall, said thin walled strip dividing said outer wall into an upper section and a lower section, said lower section defining a tear skirt;

(c) a plurality of bendable flaps formed at a lower margin of said upper section by said undulating annular groove when said tear skirt is separated from said upper section, each said flap having a relatively long and straight lower edge that is formed by said relatively long and straight portion of said undulating annular groove when said tear skirt is separated from said upper section;

(d) a fastening rib formed on an interior surface of each one of said flaps, all of said fastening ribs being disposed on said upper section that remains after separation of said tear skirt, said fastening ribs configured to be in locking engagement with the locking flange of the container, said relatively short and curved sections of said undulating annular groove being disposed between adjacent ones of said fastening ribs, said relatively long and straight section being disposed below each said fastening ribs;

(e) an opening formed in selected ones of said flaps, said openings configured to facilitate bending of said flaps for disengaging said fastening ribs and the locking flange for removing said lid from the container;

(f) a series of spaced longitudinally extending strengthening ribs formed in said undulating annular groove, said ribs extending between opposed edges of said undulating annular groove, said strengthening ribs being sufficiently thick to strengthen said frangible thin walled strip and prevent accidental tearing of said tear strip and sufficiently thin to permit said strip to be torn easily for separating said tear skirt from said outer wall;

(g) an elongated lateral slot formed in a portion of said outer wall and said undulating annular groove, a tab formed in a section of said tear skirt bounded by said lateral slot, said tab defining a purchase for facilitating separation of said tear skirt from said upper section; and (h) a weakened area formed in said tear skirt, said weakened area adjacent to and intersecting said lateral slot to facilitate breaking of said tear skirt and separation of said tear skirt from said upper section.

17. In a plastic lid for a container which comprises a lid body and a circumferentially disposed fastening means for retaining the lid on the container, said fastening means defining inwardly extending annular fastening rib means, and a circumferentially disposed undulating tear line means to permit tearing separation of a lower portion of the lid body from an upper portion of the lid body, the improvement comprising in combination:

(a) said annular fastening rib means being a plurality of spaced fastening ribs that are circumferentially disposed on an inner surface of the lid body; and (b) said tear line means being a groove defining an undulating annular path that is circumferentially disposed below and between said fastening ribs, whereby tearing of the lower portion of the lid body from the upper portion of the lid body causes removal of spaced portions of the lid body between adjacent ones of said fastening ribs, a plurality of bendable flaps formed on the upper portion of the lid body when the lower portion of the lid body is separated from the upper portion, all of said fastening ribs remaining on the upper portion of the lid body, whereby said lid, after removal of the lower portion, is more easily openable, but can still be retained on the container by the said fastening ribs on the upper portion of the lid body.

* * * * *

UNITED STATES PATENT AND TRADEMARK OFFICE

CERTIFICATE OF CORRECTION

PATENT NO. : 4,930,656

DATED : June 5, 1990

INVENTOR(S) : Henry J. Blanchette

It is certified that error appears in the above-identified patent and that said Letters Patent is hereby corrected as shown below:

Claim 12, column 6, line 42, change "assembling" to -- assembly --;

Claim 12, column 6, line 56, change "and" to -- said --;

Claim 12, column 6, line 64, change "each said flap" to -- each of said flaps --;

Claim 12, column 7, line 7, change "section" to -- sections --; and

Claim 12, column 7, line 9, change "portion" to -- portions --.

UNITED STATES PATENT AND TRADEMARK OFFICE

CERTIFICATE OF CORRECTION

PATENT NO. : 4,930,656

DATED : June 5, 1990

INVENTOR(S) : Henry J. Blanchette

It is certified that error appears in the above-identified patent and that said Letters Patent is hereby corrected as shown below:

Claim 1, column 4, line 58, delete "outer" (both occurrences); and

Claim 5, column 5, lines 38 and 39, delete "undulated".

Signed and Sealed this

Sixteenth Day of June, 1992

*Attest:*

*Attesting Officer*

DOUGLAS B. COMER

*Acting Commissioner of Patents and Trademarks*